US006145771A

United States Patent [19]

Santa Cruz et al.

[11] Patent Number: 6,145,771

[45] Date of Patent: Nov. 14, 2000

[54] PERFORATED PAPER PRODUCT DISPENSER, INCLUDING METHOD OF USE

[76] Inventors: Cathy D. Santa Cruz, 401 Canyon Way, #43, Sparks, Nev. 89434; Robert Harley Phillips, 7784 Forest Glenn Dr., Kings Beach, Calif. 96143

[21] Appl. No.: 09/085,522

[22] Filed: May 27, 1998

[51] Int. Cl.[7] ..... B65H 23/06

[52] U.S. Cl. ..... 242/423.1; 242/598.3; 225/106

[58] Field of Search ..... 242/423, 423.1, 242/598, 598.3; 221/33, 45, 46, 282; 225/106

[56] References Cited

U.S. PATENT DOCUMENTS

| | | | |
|---|---|---|---|
| 3,069,105 | 12/1962 | Press et al. | 242/598 |
| 3,850,379 | 11/1974 | Stern | 242/423.1 |
| 4,179,077 | 12/1979 | Morishita | 242/598.3 |
| 4,381,083 | 4/1983 | Tsunetsugu | 242/598.3 |
| 4,432,504 | 2/1984 | Pace | 242/598.3 |
| 4,600,162 | 7/1986 | Hidle | 242/55.2 |
| 4,824,038 | 4/1989 | Chandler | 242/598.3 |
| 4,848,690 | 7/1989 | Lemoine | 242/598.3 |
| 4,919,350 | 4/1990 | Miller | 242/423 |
| 5,135,179 | 8/1992 | Morano | 242/55.54 |
| 5,335,811 | 8/1994 | Morand | 221/45 |
| 5,449,127 | 9/1995 | Davis | 242/598.3 |
| 5,549,218 | 8/1996 | Mussen | 221/282 |
| 5,755,397 | 5/1998 | Freese | 242/423.1 |
| 5,794,882 | 8/1998 | Lewis | 242/423.1 |

*Primary Examiner*—Donald P. Walsh
*Assistant Examiner*—Emmanuel M. Marcelo

[57] ABSTRACT

A dispenser for dispensing a paper or plastic product, that allows a user to easily tear off one sheet of the product at a time. The dispenser includes a first magnetized member, a second magnetized member, a support bar and at least one stop device.

6 Claims, 2 Drawing Sheets

PERFORATED PAPER PRODUCT DISPENSER, INCLUDING METHOD OF USE

FIELD OF THE INVENTION

This invention relates to paper or plastic product dispensers, but more particularly relates to a dispenser that dispenses a single sheet of a product using one hand only. The dispenser includes a magnetized roller, a second magnetized support member, and at least one stop means.

BACKGROUND OF THE INVENTION

Dispensers for dispensing sheets of paper or plastic products off a roll of perforated sheets are well known within the prior art. However, the known dispensers require the user to activate the device using both hands, thus the user must make contact with possibly unsanitary objects in order to stabilize the supply roll. Furthermore, such prior art devices are complicated, bulky in appearance, and require two-hand operation.

The known prior art dispensers teach stop means which require the user to squeeze the end of the supply roll which is time consuming and most inefficient. Also, such stop means may allow for multiple sheets to be dispensed, rather than one sheet at a time, which is the object of the stop means. Furthermore, such prior art dispensers require many unnecessary mechanical parts that the present invention eliminates. For example, guides, cutter bars, rollers, spindles, brake plates, etc., all of which are costly to manufacture.

Accordingly, it is evident that there is a need for an improved single sheet paper towel or plastic bag dispenser that is of simple construction, is easy to install, and easy to use.

SUMMARY AND OBJECTS OF THE INVENTION

It is an object of the present invention to provide a dispenser which includes in combination, a mounting bracket, a magnetized support member, a roller bar support member and unique stop means.

It is a further object of the present invention to provide a dispenser which provides disabled individuals with an easy means of retrieving a single paper towel, and replacement of the supply roll is accomplished with use of only one hand.

It is another object of the present invention to provide a dispenser that eliminates the need for additional parts, such as cutter bars, rollers, spindles, or other cumbersome types of mechanisms.

Another object of the present invention is to provide a dispenser that may be installed for either right or left hand actuation, depending on user choice.

Yet another object of the present invention is to provide a dispenser which provides smooth operation in a simplified and efficient manner heretofore not seen or taught within the prior art.

It is a further object of the present invention to provide a dispenser and a method of use which instructs the user how to easily restrict the movement of the supply roll, by simply using a crosswise action to frictionally stop the roll, and not allow unwanted paper to be accidentally dispensed.

Still a further object of the present invention is to provide a dispenser which includes a mounting bracket. With the bracket allowing the user to either mount the bracket on a support surface of choice, such as on the underside of a cabinet structure. Or the bracket may be self-contained, and sit in a vertical position upon a support surface of choice.

Yet another object of the present invention is to provide a dispenser having a magnetized support member which is attached to the bracket at a location of user choice.

Still a further object of the present invention is to provide a dispenser that includes at least one stop means that is attached to the bracket at a location of user choice.

Also a further object of the present invention is to provide a product dispenser which can be used for dispensing multiple products of choice, such as paper towels, toilet paper, fabric sheets, plastic bags, etc.

A further object of the present invention is to provide a dispenser that is pleasing to the eye.

Yet a further object of the present invention is to provide a dispenser which can be made from substantially any suitable material of engineering choice, such as plastic, nylon, wood, metal, or the like.

Other objects and advantages will be seen when taken into consideration with the following specification and drawings.

DETAILED DESCRIPTION OF THE DRAWINGS

Figure 1:
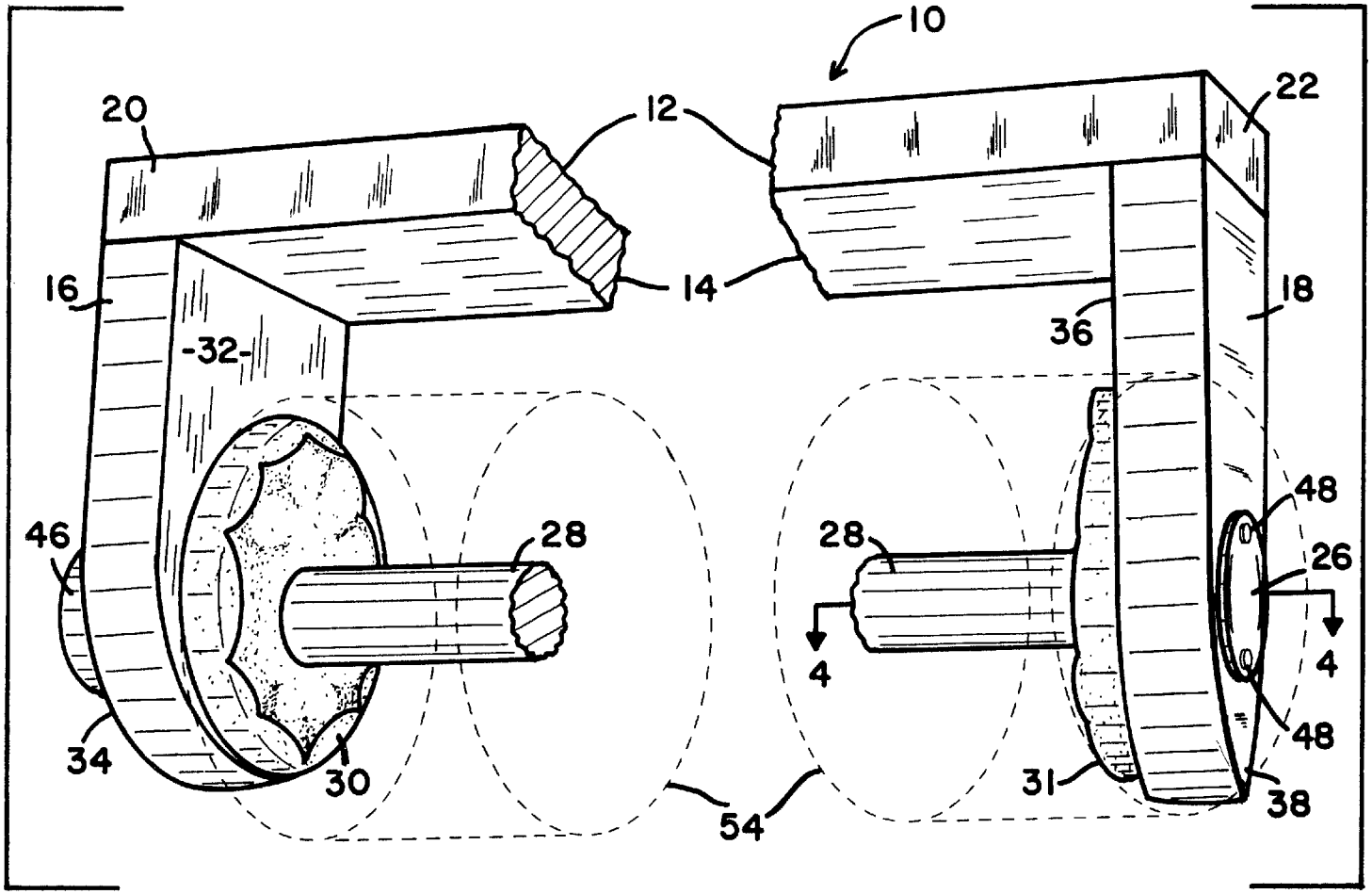
FIG. 1 is substantially a perspective overview of the preferred embodiment for the present invention.

Referring now in detail to the drawings wherein like characters refer to like elements throughout the various views. Within FIG. 1, (arrow 10) represents an overview of the present invention which is substantially a dispenser for paper or plastic products. The dispenser is unique as it allows the user to easily tear off a single sheet of a paper product, by pulling in crosswise direction.

The dispenser (arrow 10) includes a mounting bracket (12) which can be made from substantially any suitable material of engineering choice, such as plastic, wood, nylon, metal, etc. Bracket (12) can be integrally formed, or as we have herein shown, bracket (12) may be formed having a central body portion (14), a first arm support (16) and a second arm support (18). Bracket (12) having first arm (16) fixedly attached on a first end section (20) on central body portion (14), and second arm support (18) being fixedly attached on a second end section (22) on central body portion (14).

It is to be noted that each arm support (16 & 18) may be attached to the desired location by substantially any suitable attachment means of engineering choice, such as by glue, or the like. It is to be further noted that when attached, first arm support (16) and second arm support (18) are substantially aligned and opposed to each other. First arm support (16) having a bore there through and second arm support (18) having a bore there through and each bore being substantially aligned and opposed to each other. Furthermore, first arm support (16) includes an interior surface (32) and an exterior surface (34) and second arm support (18) includes an interior surface (36) and an exterior surface (38) and interior surfaces (32 & 36) are substantially aligned and opposed to each other.

Figure 4:
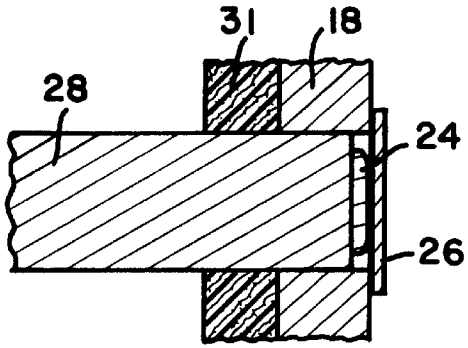
FIG. 4 is substantially a sectional cut-a-way view taken at 4—4 of FIG. 1.

The preferred embodiment is depicted in FIG. 1. Wherein dispenser (arrow 10) includes mounting bracket (12), a first magnetized support member (24) (refer to FIGS. 2 and 4), a second magnetized support member (26), a roller bar support member (28); a first stop means (30), and a second stop means (31).

Figure 2:
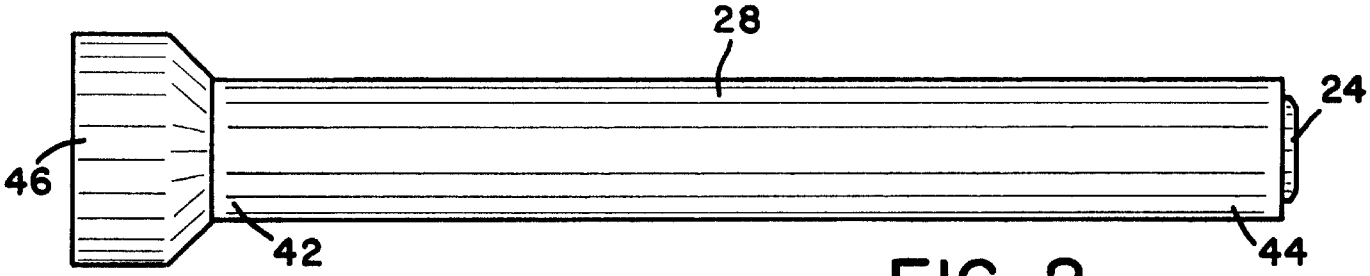
FIG. 2 is substantially a side view of a roller bar support member.

Referring now to FIG. 2, wherein we show roller bar (28), which can be made from substantially any suitable material of engineering choice, such as rubber, nylon, plastic, etc. Roller bar (28) is of a length to extend completely through each bore simultaneously and includes a first end (42) and a second end (44), with the first end (42) being of a shape and size to be easily grasped by a user. For example, first end (42) may be integrally formed at the point of manufacture, or it may be removably yet fixedly attached to a knob (46), or any other suitable grasping means of engineering choice. Furthermore, second end (44) of roller bar (28) is fixedly attached to first magnetized support member (24) by any suitable attachment means of engineering choice, such as glue, or the like.

Figure 5:
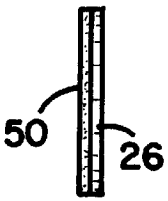
FIG. 5 is substantially a side view of a first magnetic Member.

Referring now to second magnetized support member (26) which can be of substantially of any suitable shape and size of engineering choice. Second magnetized support member (26) is attached to exterior surface (38) on second arm support (18) by any suitable attachment means of engineering choice. For example, in FIG. 1 we show second magnetized support member (26) being attached to exterior surface (38) on second arm support (18) by screws (48), while in FIG. 5, we show second magnetized support member (26) being attached by a peel-a-way adhesive strip (50).

Figure 3:
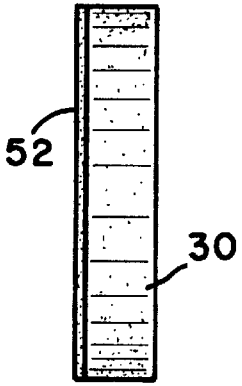
FIG. 3 is substantially a side view of a stop means

Referring now to first and second stop means (30 & 31) each of which can be of substantially any suitable material of engineering choice, such as a rubber stopper, a sprayed on rubber substance, sandpaper, or the like. However, the applicants contend that a corrugated foam rubber stopper is most efficient. First stop means (30) is attached to interior surface (32) of first arm support (16), while second stop means (31) is attached to interior surface (36) of second arm support (18). It is to be noted that each stop means (30 & 31) may be attached to the desired location by any suitable attachment means of engineering choice, such as by glue, or the like. However, as we have shown within FIG. 3, either stop means (30 or 31) may include a peel-a-way adhesive strip (52), if so desired.

It is to be further noted that roller bar support member (28) is of a shape and size to slidably support a roller thereon between both stop means (30 & 31) with the roller having interconnected perforated sheets of a paper product thereon (54). It is to be also noted that it is important to provide enough clearance between the stop means (30 & 31) and the edge of the product, so as to allow the product to roll freely around roller member (28), until the user initiates a directional force. Any suitable paper product may be used, such as a roll of toilet paper, a roll of fabric softener sheets, a roll of paper towels, or a roll of plastic bags, etc.

It is to be further noted that each magnetized member (24 & 26) are removably yet magnetically attracted and attachable together.

It will now be seen, when a user desires one sheet of the paper product, the user simply grasps the end of the desired paper product, and pulls in a crosswise motion in either a right or left direction. Thus causing one of the stop means, either (30 or 31) to be urged against the edge of the paper product creating a frictional force, resulting in one of the perforated sheets being disconnected and ready for immediate use.

It is to be noted that bracket (12) is most versatile and allows the user to install in various positions of user choice, such as on the underside surface of a kitchen cabinet, or the like. Or if preferred the user can stand the device in an upright manner, standing on one of the arm supports either (16 or 18). However, if the latter installation is desired, it is to be understood that one of the support arms (16 or 18), or a portion of bracket (12), should include a weight means (not shown) of engineering choice. For example, concrete, steel, etc. or any other suitable weight means may be used which will eliminate possible accidental tipping of dispenser (arrow 10). Also, it is to be noted if the latter installation is desired, the user would pull the paper product in an upward or downward direction, rather than in a crosswise direction.

It is to be understood that if so desired, the dispenser can be installed with only one stop means, as discussed within the following specification.

It is to be further noted that the dispenser (arrow 10) can be pre-assembled from the manufacturer, or the device can be assembled after purchase by the user. If the latter is the case, this allows the user to determine if the dispenser (arrow 10) is to be installed for either right or left hand operation. For example, if the user wishes to remove a sheet of the paper product by grasping the paper product and then pulling in a crosswise right direction, the user would install the device using the following procedure:

a. installed, in either an upright standing position or attached lengthwise to a support surface;

b. the user positions or installs the device into the desired location;

c. grasp a stop means, such as (31), peel away the attached adhesive strip (52);

d. position stop means (31) into its desired location, such as on interior surface (36) and attach stop means (31) with adhesive strip (52);

e. grasp second magnetized member (26) and peel away the attached adhesive strip (50);

f. position member (26) into its desired location, such as on exterior surface (38) and attach member (26) with adhesive (50);

g. grasping a roller with one hand of the user, with the roller having interconnected perforated sheets of a paper product (54) thereon;

h. positioning the roller at the desired location of choice within dispenser (arrow 10);

i. grasping a handle end (46) of a roller bar support member (28) with the other hand;

j. inserting the second end (44) of roller bar support member, (28) into a bore located within first arm support (16) of dispenser (arrow 10);

k. inserting second end (44) into and throughout the interior of roller having paper product (54), and into a bore located within second arm support (18) of dispenser (arrow 10); until the user feels that first magnetized support member (24) is magnetically attached to second magnetized support member (26); whereby: roller having paper product (54) thereon is now mounted on dispenser (arrow 10);

l. grasping the end of one of the sheets of paper product (54);

m. pulling the end in a crosswise right direction; whereby: one of the sheets of the paper product (54) is disengaged from the roller and ready for use.

It is to be understood that if the user desired left hand operation of the dispenser (arrow 10), then steps (d), (f), and (j), would be performed in the opposite manner.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

What is claimed is:

1. A dispenser comprising in combination: a mounting bracket; a first magnetized support member; a second magnetized support member; a roller bar support member; and a stop means; said mounting bracket comprising: a central body portion; a first support arm; and a second support arm; said first support arm being fixedly attached on a first end section of said central body portion, said second support arm being fixedly attached on a second end section of said central body portion, said first support arm and said second support arm being substantially aligned and opposed to each other, said first support arm having a bore there through, said second support arm having a bore there through, each said bore being substantially aligned and opposed to each other, said roller bar support member being of a length to extend completely through each said bore, said roller bar support member having a first end and a second end, said first end being in the shape of a knob which is easily grasped by a user, said second end being attached to said first magnetized support member by an adhesive strip, said first support arm having an interior surface and an exterior surface, said second support arm having an interior surface and an exterior surface, each said interior surface being substantially aligned and opposed to each other, said stop means being attached to said interior surface of said first support arm, said second magnetized support member being attached to said exterior surface of said second support arm, said roller bar support member being of a shape and size to slidably support a roller thereon between said stop means and said second arm support, said roller having interconnected perforated sheets of a paper product thereon, and said magnetized members being removably yet magnetically attached together, whereby:

when said user pulls on one of said sheets in a crosswise motion, said stop means causes said one of said perforated sheets to be disconnected.

2. The dispenser of claim 1 further includes a weight means positioned therein.

3. The dispenser of claim 1 further includes a second stop means which is attached to said interior surface of said second support arm;

whereby:

when said user pulls on one of said sheets in a crosswise motion, either said first stop means or said second stop means causes said one of said perforated sheets to be disconnected.

4. The dispenser of claim 1 includes a second stop means and each said stop means being formed from a sprayed on rubber substance.

5. The dispenser of claim 4 includes each said stop means being formed from sandpaper.

6. Installation and method for using a perforated paper product dispenser comprising of the following steps:

a. attaching said dispenser onto a support surface;

b. grasping a stop means and peel away the attached adhesive strip;

c. attaching said stop means onto said dispenser using said adhesive strip;

d. grasping a magnetized member and peel away an attached adhesive strip;

e. attaching said magnetized member onto said dispenser using said adhesive strip;

f. grasping a roller with one hand of the user, with said roller having interconnected perforated sheets of a paper product thereon;

g. grasping a first end of a roller bar support member with one hand;

h. inserting the second end of said roller bar support member into a first bore located within a first support arm of said dispenser;

i. inserting said second end into and throughout the interior of said roller and into a bore located within a second support arm of said dispenser; until the user feels that said first magnetized support member is magnetically attached to a second magnetized support member; whereby, said roller having paper product thereon is now mounted on said dispenser;

j. grasping the end of one of the sheets of said paper product;

k. pulling last said end in a crosswise direction; whereby, one of the sheets of said paper product is disengaged from said roller and ready for use.

* * * * *